US008795039B2

(12) United States Patent
Wang

(10) Patent No.: US 8,795,039 B2
(45) Date of Patent: Aug. 5, 2014

(54) TROUBLESHOOTED COIN OUTPUT METHOD

(71) Applicant: International Currency Technologies Corporation, Taipei (TW)

(72) Inventor: Yuan-Chun Wang, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 154 days.

(21) Appl. No.: 13/782,610

(22) Filed: Mar. 1, 2013

(65) Prior Publication Data

US 2014/0120817 A1 May 1, 2014

(30) Foreign Application Priority Data

Oct. 31, 2012 (TW) ..... 101140306 A
Dec. 25, 2012 (TW) ..... 101149777 A

(51) Int. Cl.

| | |
|---|---|
| ***G07D 1/00*** | (2006.01) |
| ***G07D 1/02*** | (2006.01) |
| ***G07D 1/04*** | (2006.01) |
| ***G07D 1/06*** | (2006.01) |

(52) U.S. Cl.
CPC .. *G07D 1/00* (2013.01); *G07D 1/04* (2013.01); *G07D 1/06* (2013.01)
USPC ..... 453/18; 194/200

(58) Field of Classification Search
USPC ..... 453/1, 2, 18, 29, 30, 32; 194/200
See application file for complete search history.

(56) References Cited

U.S. PATENT DOCUMENTS 6,776,703 B2 * 8/2004 Abe et al. ..... 453/57

* cited by examiner

*Primary Examiner* — Mark Beauchaine
(74) *Attorney, Agent, or Firm* — Muncy, Geissler, Olds & Lowe, P.C.

(57) ABSTRACT

A troubleshooted coin output method used in a coin dispensing and outputting machine including a machine main unit formed of a coin dispensing unit, a coin hopper consisting of a driver circuit, motors, coin-pushing modules and sensors and a circuit module, and coin tubes for storing coins. When outputting coins, the circuit module counts the amount of coins to be outputted subject to the amount of money to be given, and then stops the coin output operation if the outputted amount of coins does not match the amount of money to be given due to failure or one motor or any other reasons, and then counts the rest amount to be given, and then drives the other motor to output coins till that the desired amount are outputted, thereby troubleshooting the problem.

10 Claims, 7 Drawing Sheets

TROUBLESHOOTED COIN OUTPUT METHOD

This application claims the priority benefit of Taiwan patent applications number 101140306 and 101149777, filed on Oct. 31, 2012 and Dec. 25, 2012.

BACKGROUND OF THE INVENTION

1. Field of the Invention

The present invention relates to coin-dispensing technology and more particularly, to a troubleshooted coin output method used in a coin dispensing and outputting machine, which, when one coin-output motor fails to output coins from a first group coin tubes, drives the other coin-output motor to output coins from a second group coin tubes, enabling the amount of outputted coins meeting the amount of money desired to be given.

2. Description of the Related Art

Following fast development of modern technology, convenience and rapidness have become important demands in our modern daily life. Nowadays, different automatic vending machines, card dispensers, ticket machines and bill exchange machines are used everywhere to sell different products and/or to provide different services without serviceman. These machines are highly appreciated for the advantage of saving much labor and bringing convenience to people. With the selling of more and more kinds of goods, advanced vending machines need added functions.

Further, commercial automatic vending machines and amusement machines commonly provide a coin acceptor for allowing people to insert coins, achieving unmanned operation and self-checkout. Further, a coin-operated automatic vending machine or amusement machine generally uses a coin validator module to validate the authenticity and value of each inserted coin or token. Different coins or tokens have different sizes. After validation of an inserted coin, the coin will be dispensed into one of a number of coin tubes inside the machine by means of a coin dispenser. Subject to the operation of the coin dispenser, coins of different values can be separately dispensed into different coin tubes for storage. Further, commercial automatic vending machines, game consoles and consumer systems are generally equipped with a coin hopper to provide coin-exchange, change-giving and coin-return functions A coin hopper of an automatic vending machine, game console or consumer system generally comprises multiple coin-pushing modules, and multiple motors controllable to drive the respective coin-pushing modules to push coins from different coin tubes for output. However, when one motor fails, the coin hopper will be stopped, prohibiting coin output. In this case, an inserted coin cannot be returned, causing the consumer a degree of distress, inconvenience and financial loss. Further, each motor simply drives one coin-pushing module to output coins of one particular value. One motor will fail soon if it is frequently operated. When one motor fails, the coin hopper will be stopped, and the other motors cannot be operated to output coins. Further, when one motor of the coin hopper fails, the machine provider must send a maintenance technician to repair the failed motor soon. If the failed motor cannot be repaired quickly, the machine will be unable to work, leading to financial loss. Therefore, it is desirable to provide a measure that eliminates the aforesaid problems.

SUMMARY OF THE INVENTION

The present invention has been accomplished under the circumstances in view. It is therefore the main object of the present invention to provide a troubleshooted coin output method used in a coin dispensing and outputting machine including a machine main unit formed of a coin dispensing unit, a coin hopper consisting of a driver circuit, motors, coin-pushing modules and sensors and a circuit module, and coin tubes for storing coins, wherein when outputting coins, the circuit module counts the amount of coins to be outputted subject to the amount of money to be given, and then stops the coin output operation if the outputted amount of coins does not match the amount of money to be given due to failure or one motor or any other reasons, and then counts the rest amount to be given, and then drives the other motor to output coins until that the desired amount are outputted, thereby troubleshooting the problem that the outputted amount of coins does not match the amount of money to be given and effectively prolonging the total lifespan of the coin dispensing and outputting machine.

It is another object of the present invention to provide a troubleshooted coin output method used in a coin dispensing and outputting machine including a machine main unit formed of a coin dispensing unit, a coin hopper consisting of a driver circuit, motors, coin-pushing modules and sensors and a circuit module, and coin tubes arranged in first and second groups for storing coins, wherein when the coin tubes of the first group are empty during operation of a first motor of the coin hopper to output coins from the coin tubes of the first group, the circuit module will drive a second motor of the coin hopper to output coins from the coin tubes of the second group until that the desired amount are outputted, enabling the frequency of use of each motor to be approximately equal and prolonging the lifespan of the motors. Thus, all the motors can be replaced at a time after a long period of use, saving the replacement time and labor cost.

It is another object of the present invention to provide a troubleshooted coin output method used in a coin dispensing and outputting machine including a machine main unit formed of a coin dispensing unit, a coin hopper consisting of a driver circuit, motors, coin-pushing modules and sensors and a circuit module, and coin tubes arranged in first and second groups for storing coins, wherein when sensors of the circuit module sensed the storage of coins in the coin tubes of the first group is in full-level and the flag to prohibit coins from entering the coin tubes of the first group is created, the setting of the coin inlet path of the coin dispensing module will be changed, enabling coins to be guided into the coin tubes of the second group, and therefore inputted coins can be equally distributed and stored in the coin tubes of the first group and the second group.

DETAILED DESCRIPTION OF THE PREFERRED EMBODIMENT

Figure 1:
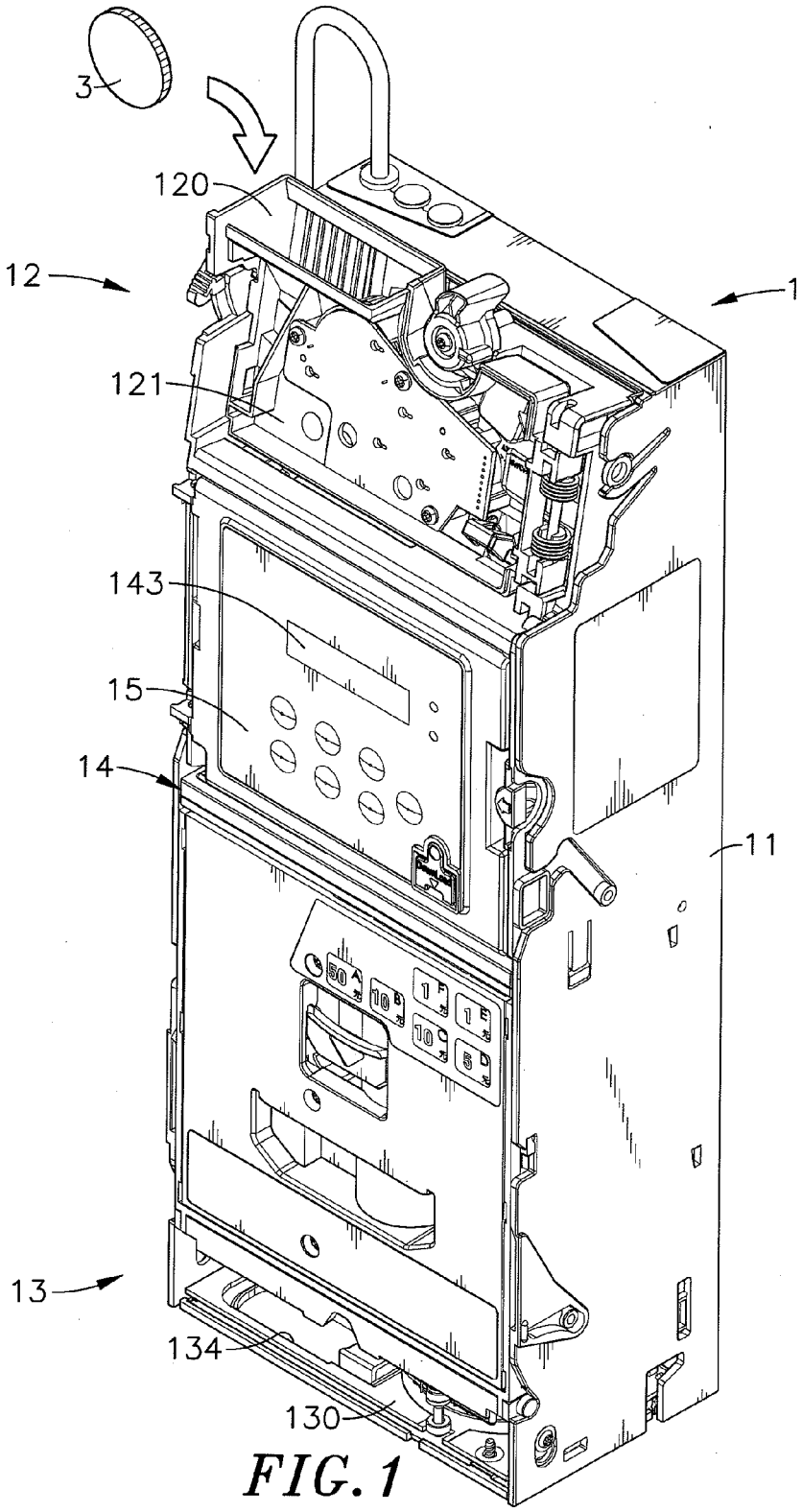
FIG. 1 is an elevational view of a coin dispensing and outputting machine in accordance with the present invention.
Figure 2:
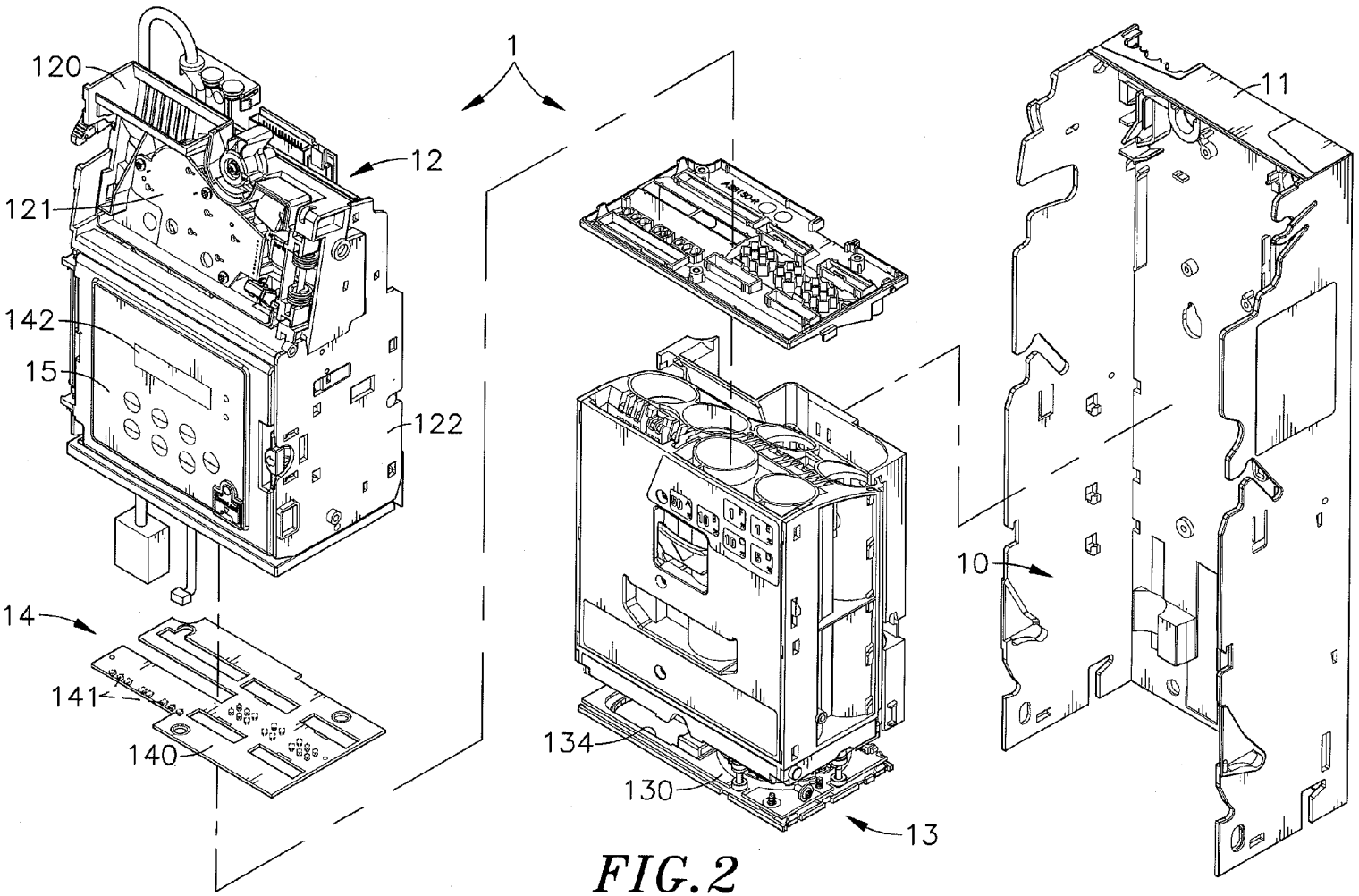
FIG. 2 is an exploded view of the coin dispensing and outputting machine in accordance with the present invention.
Figure 3:
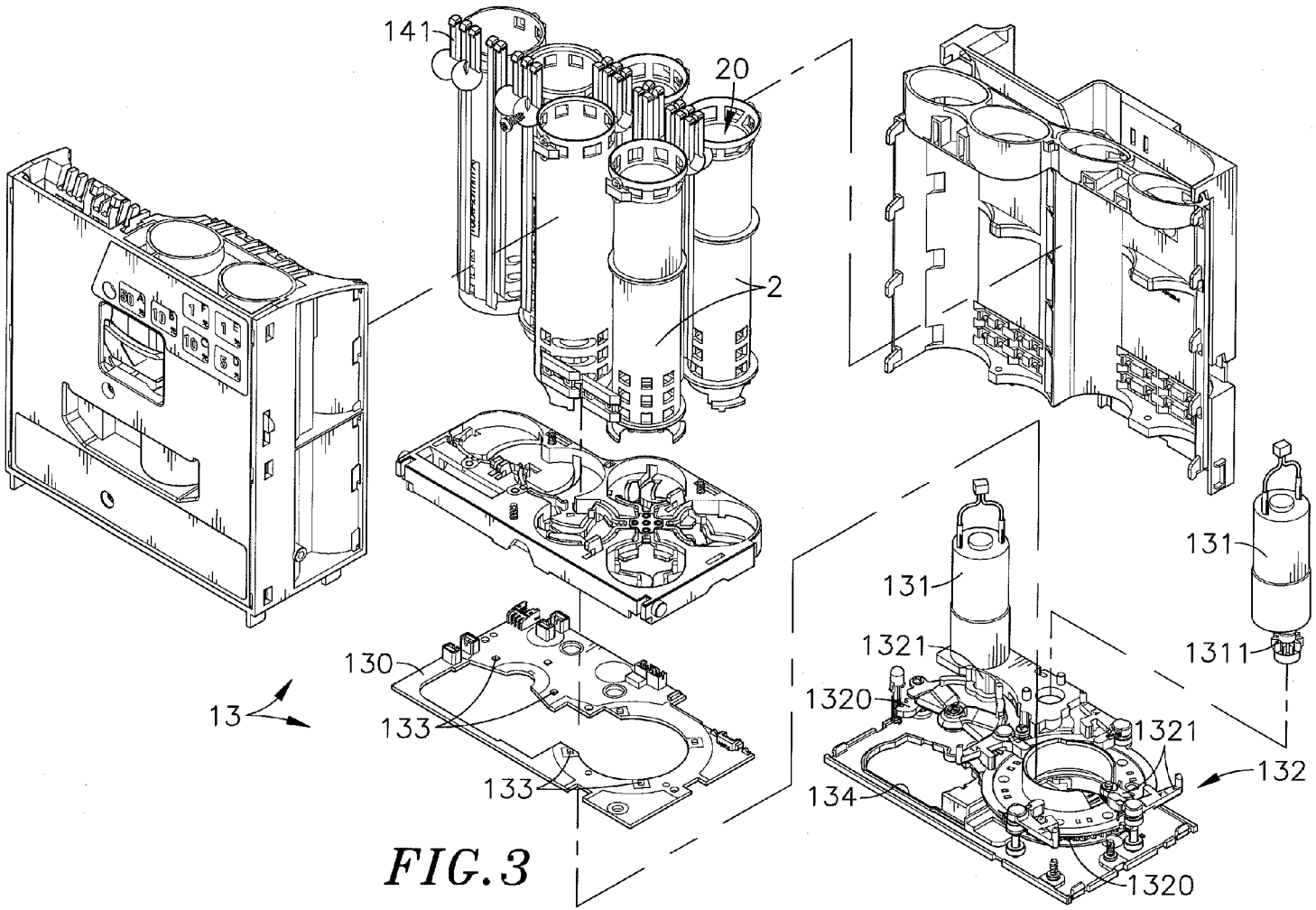
FIG. 3 is an exploded view of the coin hopper of the coin dispensing and outputting machine in accordance with the present invention.
Figure 4:
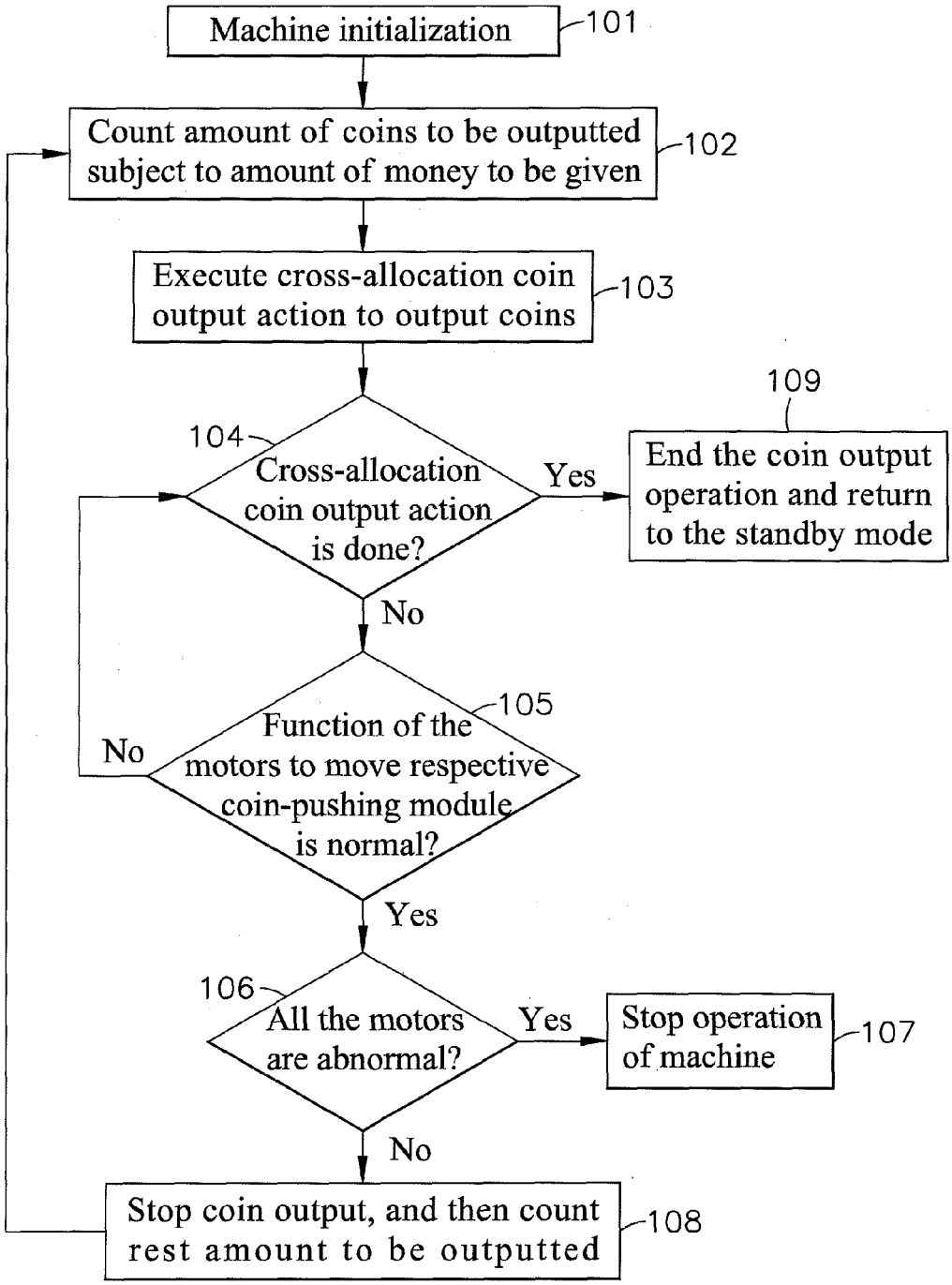
FIG. 4 is a flow chart of a troubleshooted coin output method in accordance with the present invention.
Figure 5:
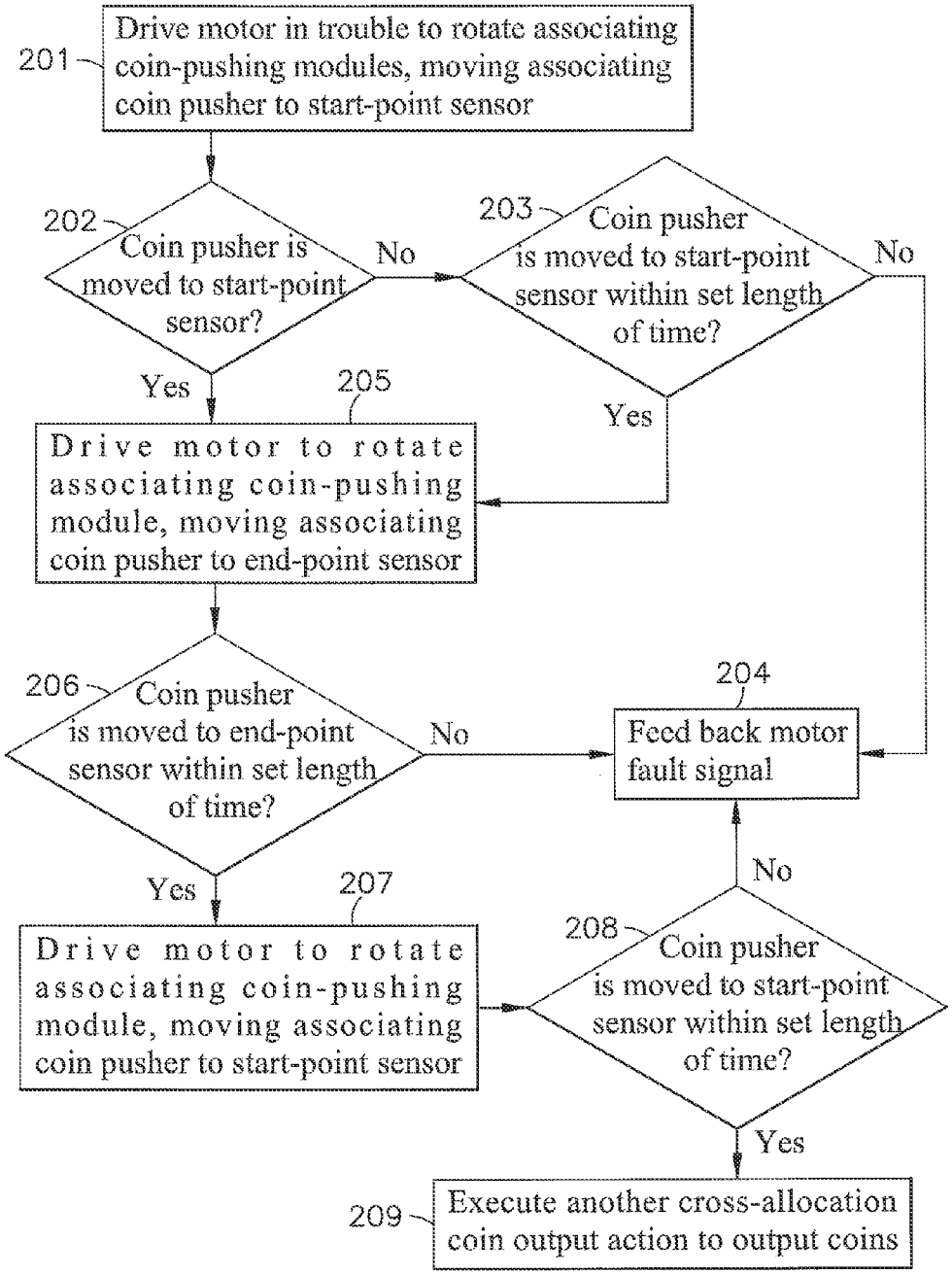
FIG. 5 is a flow chart of a motor abnormality determination action of the troubleshooted coin output method in accordance with the present invention.

Referring to FIGS. 1-5, a coin dispensing and outputting machine in accordance with the present invention is shown comprising a machine main unit 1, and a set of coin tubes 2.

The machine main unit 1 comprises a housing 11 defining therein an accommodation space 10, a coin dispensing unit 12 mounted in a top side in the accommodation space 10 inside the housing 11, a coin hopper 13 mounted in a bottom side in the accommodation space 10 inside the housing 11, and a circuit module 14 mounted in a bottom side of the coin dispensing unit 12. The set of coin tubes 2 is mounted in the coin hopper 13 at the bottom side of the coin dispensing unit 12. The coin dispensing unit 12 comprises a coin inlet 120 disposed at a top side thereof for receiving coins 3, a coin validator module 121 for validating the authenticity and values of coins 3 being put into the coin inlet 120, a coin dispensing module 122 for dispensing validated coins 3 into the coin tubes 2 in a proper order, and a face panel 15 disposed at a front side relative to the coin dispensing unit 12.

The coin hopper 13 comprises a driver circuit 130, a plurality of motors 131, a plurality of coin-pushing modules 132, and a plurality of sensors 133 for sensing displacement of the coin-pushing module 132. Each motor 131 has the output shaft thereof coupled to a gear train 1311 that is coupled to a gearwheel 1320 of one respective coin-pushing module 132, and is controlled by the driver circuit 130 to rotate the gear train 1312 and the meshed gearwheel 1320 through a predetermined angle, causing a coin pusher 1321 at the gearwheel 1320 to push one coin 3 out of the bottom side of one coin tube 2 laterally for enabling the pushed coin 3 to fall out of the coin outlet 134 at the bottom side of the coin hopper 13, and therefore the coin-exchange, change-giving or coin-return operation is done.

The circuit module 14 comprises multiple sets of sensors 141 respectively mounted around the outer perimeters of the coin tubes 2 to detect storage coins 3 in the coin tubes 2 at a low-level or full-level, a control circuit 140 made in the form of a circuit board and mounted at the bottom side of the coin dispensing unit 12 and electrically coupled with the multiple sets of sensors 141 to receive detection signals from the sensors 141 and to control on/off of the coin hopper 13 subject to the detection results of the sensors 141, and a display unit 142 electrically coupled to the control circuit 140 and mounted in the face panel 15 for displaying fault conditions. Mounting the control circuit 140 at the bottom side of the coin dispensing unit 12 is simply an installation example of the present invention. In other embodiments of the present invention, the control circuit 140 can be mounted inside the coin dispensing unit 12, or at any suitable location in the housing 11.

The coin tubes 2 are cylindrical coin storage devices for receiving sorted coins 3, each defining a cylindrical passage 20 that has a respective predetermined inner diameter for accommodating a predetermined amount of coins 3 having a specific value.

The troubleshooted coin output method is employed in the aforesaid coin dispensing and outputting machine and performed subject to the steps of:

(101) Machine initialization.

(102) Count the amount of coins 3 to be outputted from the coin tubes 2 subject to the amount of money to be given.

(103) Execute a cross-allocation coin output action to output coins 3 from the coin tubes 2.

(104) Determine whether or not the cross-allocation coin output action is done. Then proceed to step (105) if the action is not yet done, or step (109) if the action is done.

(105) Determine the normality of the function of the motors 131 to move the respective coin-pushing module 132, and then return to step (104) if the function is normal, or proceed to step (106) if the function is abnormal.

(106) Check whether or not all the motors 131 are abnormal. Then proceed to step (107) if all the motors 131 are abnormal, or step (108) if the motors 131 are not all abnormal.

(107) Stop the operation of the machine.

(108) Stop executing the action of outputting coins 3 from the coin tubes 2, and count the rest amount to be outputted, and then repeat step (102).

(109) End the coin output operation and return to the standby mode.

As stated above, the troubleshooted coin output method is used in the coin dispensing and outputting machine that can be used in an automatic game machine, a game console, or any consumer system that sells goods or services to consumers. During application, the machine main unit 1 of the coin dispensing and outputting machine is mounted in the housing of the automatic game machine, game console or consumer system and electrically connected to the internal main board of the automatic game machine, game console or consumer system, enabling the automatic game machine, game console or consumer system to provide coin-receiving, coin-dispensing and coin-recognition functions.

Before the operation of the coin hopper 13 of the machine main unit 1 to output coins, the coin dispensing and outputting machine is initialized to set all firmware default values and to run function tests, and then the machine enters the standby mode if test results are normal. When starting the coin hopper 13 to exchange coins, to give change or to return coins, the microprocessor (not shown) of the control circuit 140 of the circuit module 14 counts the amount of coins 3 to be outputted from the coin tubes 2 subject to the amount of money to be given, and then drives the coin hopper 13 to execute a cross-allocation coin output action to output coins 3 from the coin tubes 2. During a cross-allocation coin output action subject to one application example of the present invention, one motor 131 is driven to rotate the associating coin-pushing module 132 and to further push coins 3 of different values (for example, NT$50 and NT$10) out of two coin tubes 2 of a first group, and the other motor 131 is driven to rotate the associating coin-pushing module 132 and to further push coins 3 of different values (for example, NT$10, NT$5 and NT$1) out of four coin tubes 2 of a second group. This application example is for the purpose of understanding how the coin dispensing and outputting machine works, but not limitations. Further, the number and sizes of the coin tubes 2 may be changed to fit different kinds and sizes of coins 3.

However, if the control circuit 140 of the circuit module 14 detects that the coin hopper 13 cannot output coins 3 from the coin tubes 2 subject to the amount to be outputted, it will check the driver circuit 130 to see any abnormality of the function of the motors 131 in driving the respective coin-pushing modules 132. If all the motors 131 are checked failed and coin output operation cannot be done, the control circuit 140 of the circuit module 14 will immediately stop the coin hopper 13 and drive the display unit 142 to indicate fault status by means of color lights, subtitles, text or symbols. When only one particular motor 131 is checked failed, the control circuit 140 of the circuit module 14 will control the coin hopper 13 not to drive the failed motor 131 in rotating the associating gearwheel 1320 of the coin-pushing module 132, and will count the rest amount to be outputted from the coin tubes 2 and then execute a corresponding cross-allocation coin output action to output coins 3 from the coin tubes 2 until that the desired amount are outputted. After the coin output operation, the control circuit 140 of the circuit module 14 returns the machine to the standby mode.

Further, if one motor 131 is checked abnormal during the operation of the coin hopper 13 to move the coin-pushing module 132, the control circuit 140 of the circuit module 14 runs subject to the steps of:

(201) Drive the motor 131 in trouble to rotate the associating coin-pushing modules 132, moving the associating coin pusher 1321 to the start-point sensor 133.

(202) Determine whether or not the coin pusher 1321 is moved to the start-point sensor 133. Then proceed to step (203) if negative, or step (205) if positive.

(203) Determine whether or not the coin pusher 1321 is moved to the start-point sensor 133 within the set length of time. Then proceed to step (204) if negative, or step (205) if positive.

(204) Feed back motor 131 fault signal.

(205) Drive the motor 131 to rotate the associating coin-pushing module 132, moving the associating coin pusher 1321 to the end-point sensor 133.

(206) Determine whether or not the coin pusher 1321 is moved to the end-point sensor 133 within the set length of time. Then return to step (204) if negative, or proceed to step (207) if positive.

(207) Drive the motor 131 to rotate the associating coin-pushing module 132, moving the associating coin pusher 1321 to the start-point sensor 133.

(208) Determine whether or not the coin pusher 1321 is moved to the start-point sensor 133 within the set length of time. Then return to step (204) if negative, or proceed to step (209) if positive.

(209) Execute another cross-allocation coin output action to output coins 3 from the other coin tubes 2.

As stated above, if one motor 131 fails or the coin hopper 13 cannot output coins due to any other reasons, the control circuit 140 of the circuit module 14 checks the driver circuit 130 to see any abnormality of the function of the motors 131. At this time, the sensors 133 are controlled to detect movement of each coin pusher 1321 from the start-point to the end-point. When one motor 131 drives the associating coin-pushing module 132 to move the associating coin pusher 1321 to the start-point, the sensor 133 at the start-point senses the presence of the respective coin pusher 1321. If the respective coin pusher 1321 does not reach the start-point within the set length of time, a fault signal will be fed back from the motor 131 to the control circuit 140 of the circuit module 14, enabling the control circuit 140 to display the fault signal through the display unit 142. If the coin pusher 1321 is detected at the start-point or checked reached the start-point within the set length of time, the control circuit 140 will immediately drive the motor 131 to rotate the associating coin-pushing modules 132, moving the associating coin pusher 1321 to the sensor 133 at the end-point.

After the motor 131 drives the associating coin-pushing module 132 to move the associating coin pusher 1321 to the sensor 133 at the end-point, the control circuit 140 checks whether or not the coin pusher 1321 reaches the sensor 133 at the end-point. If the coin pusher 1321 does not reach the sensor 133 at the end-point within the set length of time, a fault signal will be fed back to the control circuit 140, enabling the control circuit 140 to display the fault signal through the display unit 140. If the coin pusher 1321 reaches the sensor 133 at the end-point within the set length of time, the control circuit 140 can control other motors 131 to rotate the respective coin-pushing modules 132, running another cross-allocation coin output action to output coins 3 from the other coin tubes 2 until the desired amount is outputted. This troubleshooted coin output method prevents user coin loss, effectively prolongs the lifespan of the coin hopper 13, and enhances the competivity of the consumer system using this troubleshooted coin output method.

Figure 6:
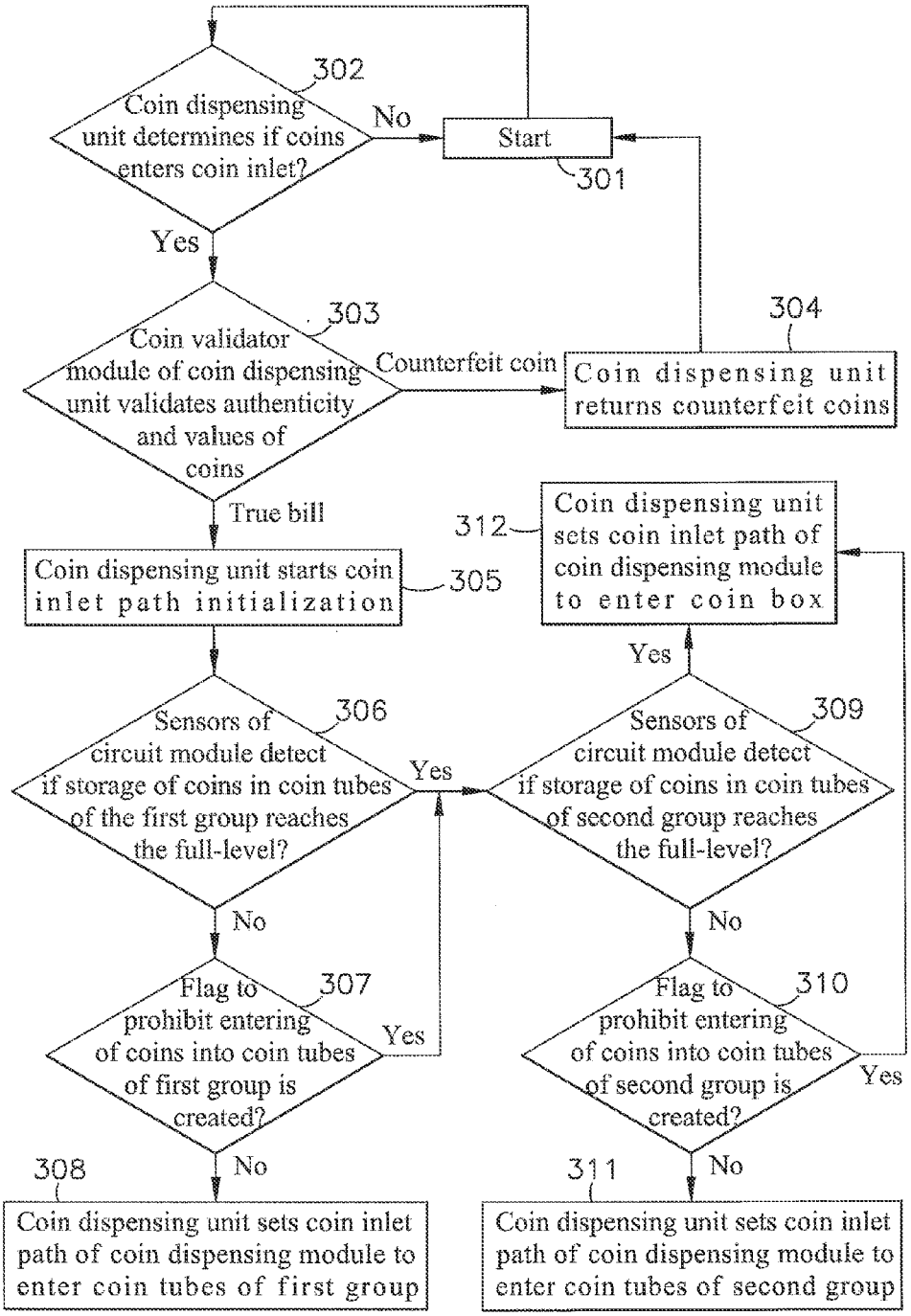
FIG. 6 is a flow chart of a cross-allocation coin dispensing action of the troubleshooted coin output method in accordance with the present invention.
Figure 7:
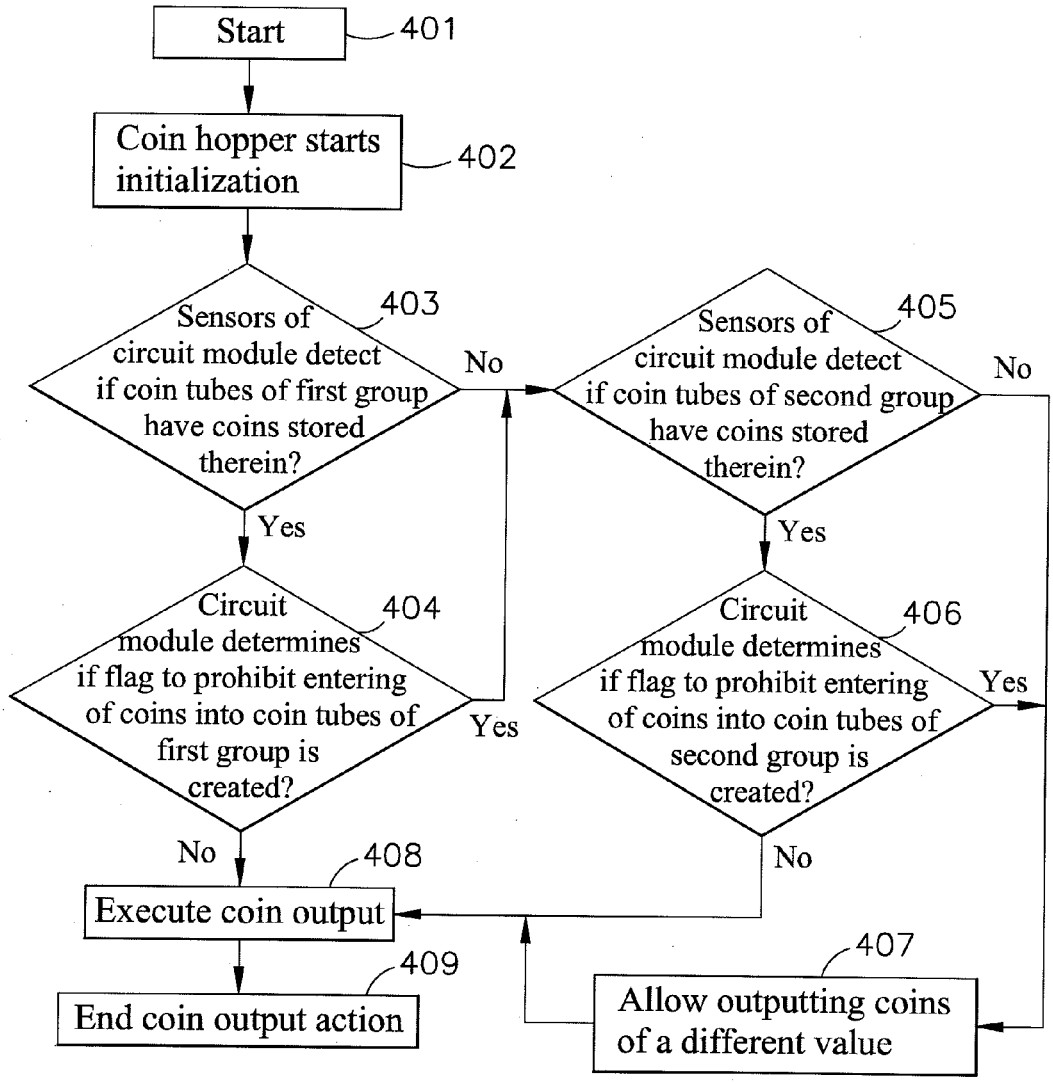
FIG. 7 is a flow chart of a cross-allocation coin output action of the troubleshooted coin output method in accordance with the present invention.

Referring to FIGS. 6 and 7, when coins 3 are fed into the coin inlet 120 of the coin dispensing unit 12, the coin dispensing unit 12 runs a cross-allocation coin dispensing action to dispense coins 3 into the coin tubes 2 subject to the steps of:

(301) Start.

(302) The coin dispensing unit 12 determines whether or not coins 3 enters the coin inlet 120. Then the coin dispensing unit 12 proceeds to step (303) if coins 3 enters the coin inlet 120, or returns to step (301) if no coin enters the coin inlet 120.

(303) The coin validator module 121 of the coin dispensing unit 12 validates the authenticity and values of the coins 3, and then the coin dispensing unit 12 proceeds to step (304) if the coins 3 are counterfeit coins, or step (305) if the coins 3 are real coins.

(304) The coin dispensing unit 12 returns the counterfeit coins 3, and then the coin dispensing unit 12 returns to step (301).

(305) The coin dispensing unit 12 starts coin inlet path initialization.

(306) The sensors 141 of the circuit module 14 detect whether or not the storage of coins 3 in the coin tubes 2 of the first group reaches the full-level. Then, the coin dispensing unit 12 proceeds to step (307) if negative, or step (309) if positive.

(307) Determine whether or not the flag to prohibit entering of coins into the coin tubes 2 of the first group is created. Then the coin dispensing unit 12 proceeds to step (308) if the flag is not created, or step (309) if the flag is created.

(308) The coin dispensing unit 12 sets the coin inlet path of the coin dispensing module 122 to enter the coin tubes 2 of the first group.

(309) The sensors 141 of the circuit module 14 detect whether or not the storage of coins 3 in the coin tubes 2 of the second group reaches the full-level. Then, the coin dispensing unit 12 proceeds to step (310) if negative, or step (312) if positive.

(310) Determine whether or not the flag to prohibit entering of coins into the coin tubes 2 of the second group is created. Then the coin dispensing unit 12 proceeds to step (311) if the flag is not created, or step (312) if the flag is created.

(311) The coin dispensing unit 12 sets the coin inlet path of the coin dispensing module 122 to enter the coin tubes 2 of the second group.

(312) The coin dispensing unit 12 sets the coin inlet path of the coin dispensing module 122 to enter a predetermined coin box.

As stated above, when coins 3 are put into the coin inlet 120 of the coin dispensing unit 12, the coin dispensing unit 12 judges that coins 3 enters, and then drives the coin validator module 121 to validate the authenticity and values of the coins 3. If the coins 3 are counterfeit coins, the coin dispensing unit 12 returns the counterfeit coins 3. If the coins 3 are real coins, the coin dispensing unit 12 starts coin inlet path initialization to set all firmware parameters. If the flag to prohibit coins from entering the coin tubes 2 of the first group is not created after the sensors 141 of the circuit module 14 detected that the storage of coins 3 in the coin tubes 2 of the first group is in the low level, the coin dispensing unit 12 sets the coin inlet path of the coin dispensing module 122 to guide the coins 3 into the coin tubes 2 of the first group.

If the sensors 141 of the circuit module 14 detected the storage of coins 3 in the coin tubes 2 of the first group is in the full-level or the flag to prohibit coins from entering the coin tubes 2 of the first group is created, the sensors 141 of the circuit module 14 will then detect whether or not the storage of coins 3 in the coin tubes 2 of the second group to be in the full-level. If the storage of coins 3 in the coin tubes 2 of the second group is in the full-level and the flag to prohibit coins from entering the coin tubes 2 of the first group is not created, the coin dispensing unit 12 sets the coin inlet path of the coin dispensing module 122 to guide the coins 3 into the predetermined coin box.

However, if the sensors 141 of the circuit module 14 detects the storage of coins 3 in the coin tubes 2 of the second group is in the low level or the flag to prohibit coins from entering the coin tubes 2 of the second group is not created, the coin dispensing unit 12 sets the coin inlet path of the coin dispensing module 122 to guide the coins 3 into the coin tubes 2 of the second group. This cross-allocation coin dispensing measure can change the setting of the coin inlet path of the coin dispensing module 122 if the storage of coins 3 in the coin tubes 2 of the first group is in the full-level, enabling the inputted coins 3 to be guided into the coin tubes 2 of the second group and then guided into the predetermined coin box or other coin tubes 2 when the storage of coins 3 in the coin tubes 2 of the second group reaches the full-level. Thus, inputted coins can be properly distributed into the coin tubes 2 of the first group and the coin tubes 2 of the second group.

Further, when the coin hopper 13 executes the cross-allocation coin output action to output coins 3 from the coin tubes 2, the coin dispensing and outputting machine runs subject to the steps of:

(401) Start.

(402) The coin hopper 13 starts initialization.

(403) The sensors 141 of the circuit module 14 detect whether or not the coin tubes 2 of the first group have coins 3 stored therein. Then, the coin dispensing and outputting machine proceeds to step (404) if the coin tubes 2 have coins 3 stored therein, or step (405) if the coin tubes 2 are empty.

(404) The circuit module 14 determines whether or not the flag to prohibit entering of coins into the coin tubes 2 of the first group is created. Then, the coin dispensing and outputting machine proceeds to step (405) if the flag is created, or step (408) if the flag is not created.

(405) The sensors 141 of the circuit module 14 detect whether or not the coin tubes 2 of the second group have coins 3 stored therein. Then, the coin dispensing and outputting machine proceeds to step (406) if the coin tubes 2 have coins 3 stored therein, or step (407) if the coin tubes 2 are empty.

(406) The circuit module 14 determines whether or not the flag to prohibit entering of coins into the coin tubes 2 of the second group is created. Then, the coin dispensing and outputting machine proceeds to step (407) if the flag is created, or step (408) if the flag is not created.

(407) Allow outputting coins 3 of a different value from the coin tubes 2.

(408) Execute coin output.

(409) End the coin output action.

As stated above, when executing the cross-allocation coin output action to output coins 3 from the coin tubes 2, the coin hopper 13 initializes all the firmware parameters. After the sensors 141 of the circuit module 14 detects that the coin tubes 2 of the first group have coins 3 stored therein and the flag to prohibit entering of coins into the coin tubes 2 of the first group is not created, one motor 131 of the coin hopper 13 will be driven to move the associating coin-pushing module 132, outputting coins 3 from the coin tubes 2 of the first group. When the coin output action is done, the coin dispensing and outputting machine immediately returns to the standby mode. If the sensors 141 of the circuit module 14 detected that the coin tubes 2 of the first group have coins 3 are empty or the flag to prohibit entering of coins into the coin tubes 2 of the first group is created, the sensors 141 of the circuit module 14 will detect coin storage status of the coin tubes 2 of the second group. If the coin tubes 2 of the second group have coins 3 stored therein and the flag to prohibit entering of coins into the coin tubes 2 of the second group is not created, the other motor 131 of the coin hopper 13 will be driven to move the associating coin-pushing module 132, outputting coins 3 from the coin tubes 2 of the second group.

Further, if the sensors 141 of the circuit module 14 detects that the coin tubes 2 of the first group have coins 3 are empty or the flag to prohibit entering of coins 3 into the coin tubes 2 of the first group is created, the circuit module 14 will stop the coin hopper 13 from outputting coins, and will count the rest amount to be outputted, and will then drive the coin hopper 13 to output coins 3 of a different value from the coin tubes 2. For example, change the way of outputting coins of one first value (for example, NT$10) from the coin tubes 2 of the first group and the coin tubes 2 of the second group to the way of outputting coins 3 of two different values (for example, NT$5 and NT$1) from the coin tubes 2 of the second group, and then return to the standby mode after the desired amount is outputted. Thus, after one motor 131 of the coin hopper 13 drove the associating coin-pushing module 132 to output all coins 3 from the coin tubes 2 of the first group, the other motor 131 of the coin hopper 13 will be driven to move the associating coin-pushing module 132 and to further output coins 3 from the coin tubes 2 of the second group. This method enables the frequency of use of each motor 131 to be approximately equal, prolonging the lifespan of the motors 131. Thus, all the motors 131 can be replaced at a time after a long period of use, saving the replacement time and labor cost.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A troubleshooted coin output method used in a coin dispensing and outputting machine comprising a machine main unit and a plurality of coin tubes arranged in a first group and a second group, said machine main unit comprising a coin dispensing unit, a coin hopper and a circuit module, said coin dispensing unit comprising a coin inlet, said coin hopper comprising a driver circuit, a plurality of motors, a plurality of coin-pushing modules and a plurality of sensors, said circuit module comprising multiple sets of sensors, a control circuit and a display unit, the troubleshooted coin output method comprising the steps of:

(a1) starting initialization before coin output;

(a2) counting the amount of coins to be outputted from said coin tubes subject to the amount of money to be given;

(a3) executing a cross-allocation coin output action to output coins from said coin tubes;

(a4) determining whether or not the cross-allocation coin output action has been done, and then proceeding to step (a5) if the action is not done, or step (a9) if the action is done;

(a5) determining the normality of the function of a motor to move said coin-pushing module, and then returning to step (a4) if the function is normal, or proceeding to step (a6) if the function is abnormal;

(a6) checking if all said motors are abnormal, and then proceeding to step (a7) if all said motors are abnormal, or step (a8) if all said motors are not abnormal;

(a7) stopping the operation of the machine;

(a8) stopping executing the action to output coins from said coin tubes, and then counting the remaining amount to be outputted, and then returning to step (a2);

(a9) ending the coin output operation and returning to a standby mode.

2. The troubleshooted coin output method as claimed in claim 1, wherein when entered step (a2), said control circuit of said circuit module counts the amount of coins to be outputted from said coin tubes subject to the amount of money to be given, and then drives said coin hopper to output coins from said coin tubes or to stop outputting coins.

3. The troubleshooted coin output method as claimed in claim 1, wherein when determining the normality of the function of said motors to move said coin-pushing module during step (a5), said control circuit of said circuit module runs subject to the steps of:

(b1) driving said motor in trouble to rotate the associated said coin-pushing modules to move an associated coin pusher to a start point sensor of said coin hopper at a start-point;

(b2) determining whether or not said coin pusher has been moved to the sensor at said start-point, and then proceeding to step (b3) if negative, or step (b5) if positive;

(b3) determining whether or not said coin pusher is moved to the sensor at said start-point within the set length of time, and then proceeding to step (b4) if negative, or step (b5) if positive;

(b4) feeding back a motor fault signal;

(b5) driving said motor to rotate the associated said coin-pushing module to move the associated associating said coin pusher to the sensor at said start-point;

(b6) determining whether or not said coin pusher is moved to the sensor at said start-point within the set length of time then returning to step (b4) if negative, or proceeding to step (b7) if positive;

(b7) driving said motor to rotate the associated said coin-pushing module to move the associated said coin pusher to the sensor at said start-point;

(b8) determining whether or not said coin pusher has been moved to the sensor at said start-point within the set length of time, and then returning to step (b4) if negative, or proceed to step (b9) if positive;

(b9) executing another cross-allocation coin output action to output coins from the other group of said coin tubes.

4. The troubleshooted coin output method as claimed in claim 3, wherein when determining the normality of the function of said motors to move said coin-pushing module during step (a5), said circuit module checks said driver circuit of said coin hopper to determine an abnormality of said motors by driving said sensors of said coin hopper to detect movement of each said coin pusher from said start-point to an end-point.

5. The troubleshooted coin output method as claimed in claim 1, wherein when entering step (a7) to stop the operation of the machine, said control circuit of said circuit module drives said display unit to indicate the abnormality by means of color lights, subtitles, text or symbols.

6. The troubleshooted coin output method as claimed in claim 1, wherein when coins are fed into said coin inlet of said coin dispensing unit, said coin dispensing unit runs a cross-allocation coin dispensing action to dispense coins into said coin tubes subject to the steps of:

(c01) start;

(c02) said coin dispensing unit determines whether or not coins enter said coin inlet, and then said coin dispensing unit proceeding to step (c03) if coins enter said coin inlet, or returning to step (c01) if no coin enters said coin inlet;

(c03) said coin dispensing unit validating the authenticity and value of each entered coin, and then said coin dispensing unit proceeding to step (c04) if any entered coin is a counterfeit coin, or step (c05) if each entered coin is a real coin;

(c04) said coin dispensing unit returning each counterfeit corn, and then said coin dispensing unit returning to step (c01);

(c05) said coin dispensing unit starting coin inlet path initialization;

(c06) said sensors of said circuit module detecting whether or not the storage of coins in said coin tubes of said first group reaches the full-level, and then, said coin dispensing unit proceeding to step (c07) if negative, or step (c09) if positive;

(c07) determining whether or not the flag to prohibit entering of coins into said coin tubes of said first group has been created, and then said coin dispensing unit proceeding to step (c08) if the flag is not created, or step (c09) if the flag is created;

(c08) said coin dispensing unit setting the coin inlet path to enter said coin tubes of said first group;

(c09) said sensors of said circuit module detecting whether or not the storage of coins in said coin tubes of said second group reaches the full-level, and then, said coin dispensing unit proceeding to step (c10) if negative, or step (c12) if positive;

(c10) determining whether or not the flag to prohibit entering of coins into said coin tubes of said second group is created, and then said coin dispensing unit proceeding to step (c11) if the flag is not created, or step (c12) if the flag is created;

(c11) said coin dispensing unit setting the coin inlet path to enter said coin tubes of said second group;

(c12) said coin dispensing unit setting the coin inlet path to enter a predetermined coin box.

7. The troubleshooted coin output method as claimed in claim 1, wherein when coin hopper executes the cross-allocation coin output action to output coins from said coin tubes, the method drives said coin dispensing and outputting machine to run subject to the steps of:

(d1) start;

(d2) said coin hopper starting initialization;

(d3) said sensors of said circuit module detecting whether or not said coin tubes of said first group have coins stored therein, and then, proceeding to step (d4) if said coin tubes have coins stored therein, or step (d5) if said coin tubes are empty;

(d4) said circuit module determining whether or not the flag to prohibit entering of coins into said coin tubes of said first group is created, and then, proceeding to step (d5) if the flag is created, or step (d8) if the flag is not created;

(d5) said sensors of said circuit module detecting whether or not said coin tubes of said second group have coins stored therein, and then, proceeding to step (d6) if said coin tubes have coins stored therein, or step (d7) if said coin tubes are empty;

(d6) said circuit module determining whether or not the flag to prohibit entering of coins into said coin tubes of said second group is created, and then, proceeding to step (d7) if the flag is created, or step (d8) if the flag is not created;

(d7) allowing output of coins of a different value from said coin tubes;

(d8) executing coin output;

(d9) ending the coin output action.

8. The troubleshooted coin output method as claimed in claim 1, wherein said coin dispensing unit comprises a coin validator module adapted to validate the authenticity and value of each entered coin, and a coin dispensing module adapted to guide each entered coin to one said coin tube.

9. The troubleshooted coin output method as claimed in claim 1, wherein each said motor has an output shaft thereof coupled to a gear train that is coupled to a gearwheel of one said coin-pushing modules, and is controlled by said driver circuit to rotate said gear train and said gearwheel through a predetermined angle, causing a coin pusher at said gearwheel to push one coin out of a bottom side of one said coin tube laterally.

10. The troubleshooted coin output method as claimed in claim 1, wherein said circuit module comprises multiple sets of sensors respectively mounted around the outer perimeters of said coin tubes to detect storage coins in said coin tubes in low-level or full-level, a control circuit electrically coupled with said multiple sets of sensors to receive detection signals from the sensors of said circuit module and to control on/off of said coin hopper subject to the detection results of the sensors of said circuit module.

* * * * *